US005174365A

United States Patent [19]

Noguchi et al.

[11] Patent Number: 5,174,365

[45] Date of Patent: Dec. 29, 1992

[54] AIR CONDITIONING APPARATUS WHICH SELECTIVELY CARRIES OUT A REFRIGERANT COLLECTION OPERATION

[75] Inventors: Haruo Noguchi; Akihisa Nakazawa, both of Shizuoka, Japan

[73] Assignee: Kabushiki Kaisha Toshiba, Kanagawa, Japan

[21] Appl. No.: 791,483

[22] Filed: Nov. 12, 1991

[30] Foreign Application Priority Data

Nov. 30, 1990 [JP] Japan ..... 2-340366

[51] Int. Cl.[5] ..... F25B 29/00; F25B 41/00; F24F 5/00

[52] U.S. Cl. ..... 165/29; 62/160; 62/174; 62/238.6; 62/238.7; 62/324.4; 237/2 B

[58] Field of Search ..... 165/29; 62/160, 174.4, 62/324.4, 238.6, 238.7; 237/2 B

[56] References Cited

U.S. PATENT DOCUMENTS

| | | | |
|---|---|---|---|
| 4,441,331 | 4/1984 | Yuyama | 165/29 |
| 4,484,452 | 11/1984 | Houser, Jr. | 62/174 |
| 4,506,521 | 3/1985 | Asano et al. | 62/324.1 |
| 4,516,408 | 5/1985 | Chiba | 62/238.7 |
| 4,765,149 | 8/1988 | Shiga et al. | 62/324.4 |
| 4,802,529 | 2/1989 | Sumitani et al. | 62/238.6 |
| 4,876,778 | 10/1989 | Hagihara et al. | 29/157.3 A |
| 4,905,894 | 3/1990 | Noguchi | 237/2 B |
| 5,009,077 | 4/1991 | Okoshi et al. | 62/324.4 |
| 5,088,296 | 2/1992 | Hamaoka | 62/324.4 |

FOREIGN PATENT DOCUMENTS

| | | | |
|---|---|---|---|
| 0027144 | 2/1984 | Japan | 62/324.4 |
| 2-150672 | 6/1990 | Japan . | |
| 1577978 | 10/1980 | United Kingdom . | |
| 1593521 | 7/1981 | United Kingdom . | |
| 2223330A | 4/1990 | United Kingdom . | |

*Primary Examiner*—John K. Ford
*Attorney, Agent, or Firm*—Limbach & Limbach

[57] ABSTRACT

An air conditioning apparatus carrying out a refrigerant collecting operation for a given operation period before the heating operation is begun if the standby period Et from the halt of the heating operation to the restart of the heating operation greater than the prescribed period Pt, the temperature Ta in a defined space to be heated lower than the predetermined temperature value Ts1, and the external temperature Tex lower than the given temperature value Ts2 are satisfied when the restart of the heating operation is commanded.

11 Claims, 6 Drawing Sheets

AIR CONDITIONING APPARATUS WHICH SELECTIVELY CARRIES OUT A REFRIGERANT COLLECTION OPERATION

BACKGROUND OF THE INVENTION

1. Field of the Invention

The present invention relates, in general, to air conditioning apparatus. In particular, the invention relates to an air conditioning apparatus employing a refrigerant heating device which heats refrigerant in a heating operation.

2. Description of the Related Art

A heat-pump type air conditioning apparatus is well known and is used as a heater in winter season. In a heating operation, an external heat-exchanger of the heat-pump type air conditioning apparatus acts as an evaporator and an internal heat-exchanger acts as a condenser. Refrigerant taken into the compressor absorbs heat from the atmosphere through the evaporator and refrigerant output from the compressor discharges heat through the condenser into a defined space to be heated. The above-described heating cycle is repeatedly carried out to provide heat into the defined space.

In the above-described conventional air conditioning apparatus, a refrigerant collecting operation is generally carried out to collect refrigerant from the heat-exchanger to the compressor when the heating operation is reexecuted. During the refrigerant collecting operation, the above-described heating cycle has not been carried out. Thus, the start of the heating operation is delayed when the heating operation is commanded.

An air conditioning apparatus including a refrigerant heating device is well known. In this type of the air conditioning apparatus, two different external heat-exchangers may be used in one refrigerating circuit. One is an ordinary type of the heat-exchanger which is used in a cooling operation, as a condenser. The other is a heat-exchanger of the refrigerant heating device which is used as an evaporator in a heating operation. When the restart of the heating operation is commanded, the heating operation is immediately carried out without executing the refrigerant collecting operation.

In such a conventional air conditioning apparatus including a refrigerant heating device, the closed heating circuit is maintained by the four-way valve being activated after the heating operation is halted. Thus, escape of refrigerant, so called a hot gas, from the closed heating circuit to the external heat-exchanger which is used in a cooling operation is avoided.

However, owing to the inherency of the mechanical arrangement of the four-way valve, an amount of refrigerant leaking from the high pressure side of the compressor through the four-way valve to the external heat-exchanger acting as a condenser in a cooling operation is increased if a period of time from the halt of the heating operation to restart of the heating operation is extended or the external temperature is excessively low. If the heating operation is restarted without collecting the increased amount of a leaked refrigerant in the heat-exchanger as described above, the shortage of refrigerant occurs in the closed heating circuit, and thus a heating capacity of the air conditioning apparatus is decreased.

On the other hand, the above-described refrigerant collecting operation is carried out for a prescribed period of time (a fixed value) measured by a timer. The refrigerant collecting operation is promoted if the external temperature is high. The suction pressure of the compressor becomes negative, and then an unusual operation, so called a vacuum driving, of the compressor may occur. The compressor is operated in a vacuum condition. Thus, the high compressing pressure section of the compressor is overheated and is damaged if such an unusual operation of the compressor is continued.

SUMMARY OF THE INVENTION

Accordingly, it is an object of the present invention to achieve a suitable heating capacity by an air conditioning apparatus including a refrigerant heating device even if the actual external temperature is low.

It is another object of the invention to selectively carry out a refrigerant collecting operation by an air conditioning apparatus including a refrigerant heating device when the heating operation is restarted.

To accomplish the above-described objects, an air conditioning apparatus includes:

an air conditioning unit, including a first heat-exchanger and a first fan device, for conditioning a defined space to be air conditioned;

a refrigerant supply unit, including a variable capacity compressor, a four-way valve, a second heat-exchanger, a second fan device, a decompressing device and a refrigerant heating device, for supplying refrigerant to the air conditioning unit, the refrigerant heating device having a third heat-exchanger and a heating unit;

timer means for measuring a standby period Et from the halt of a heating operation to the restart of the heating operation;

means for detecting a temperature Ta in the defined space;

means for detecting an external temperature Tex;

control means for selectively operating the refrigerant heating device in accordance with the standby period Et, the temperature Ta in the defined space and the external temperature Tex to carry out a refrigerant collecting operation wherein refrigerant stored in the second heat-exchanger is collected to the compressor before the heating operation is begun when the restart of the heating operation is commanded after the heating operation is halted.

The control means may include means for carrying out the refrigerant collecting operation for a given operation period Tg before the heating operation is begun if the standby period Et greater than the prescribed period Pt, the temperature Ta lower than the predetermined temperature value Ts1, and the external temperature Tex lower than the given temperature value Ts2 are satisfied when the restart of the heating operation is commanded.

BRIEF DESCRIPTION OF THE DRAWINGS

These and other objects and advantages of this invention will become apparent from the following detailed description of the presently preferred embodiment of the invention, taken in conjunction with the accompanying drawings of which.

DETAILED DESCRIPTION OF THE PREFERRED EMBODIMENTS

Preferred embodiments of the present invention will now be described with reference to accompanying drawings. However, same numerals are applied to similar elements throughout the accompanying drawings, and therefore the detailed descriptions thereof are not repeated.

Figure 1:
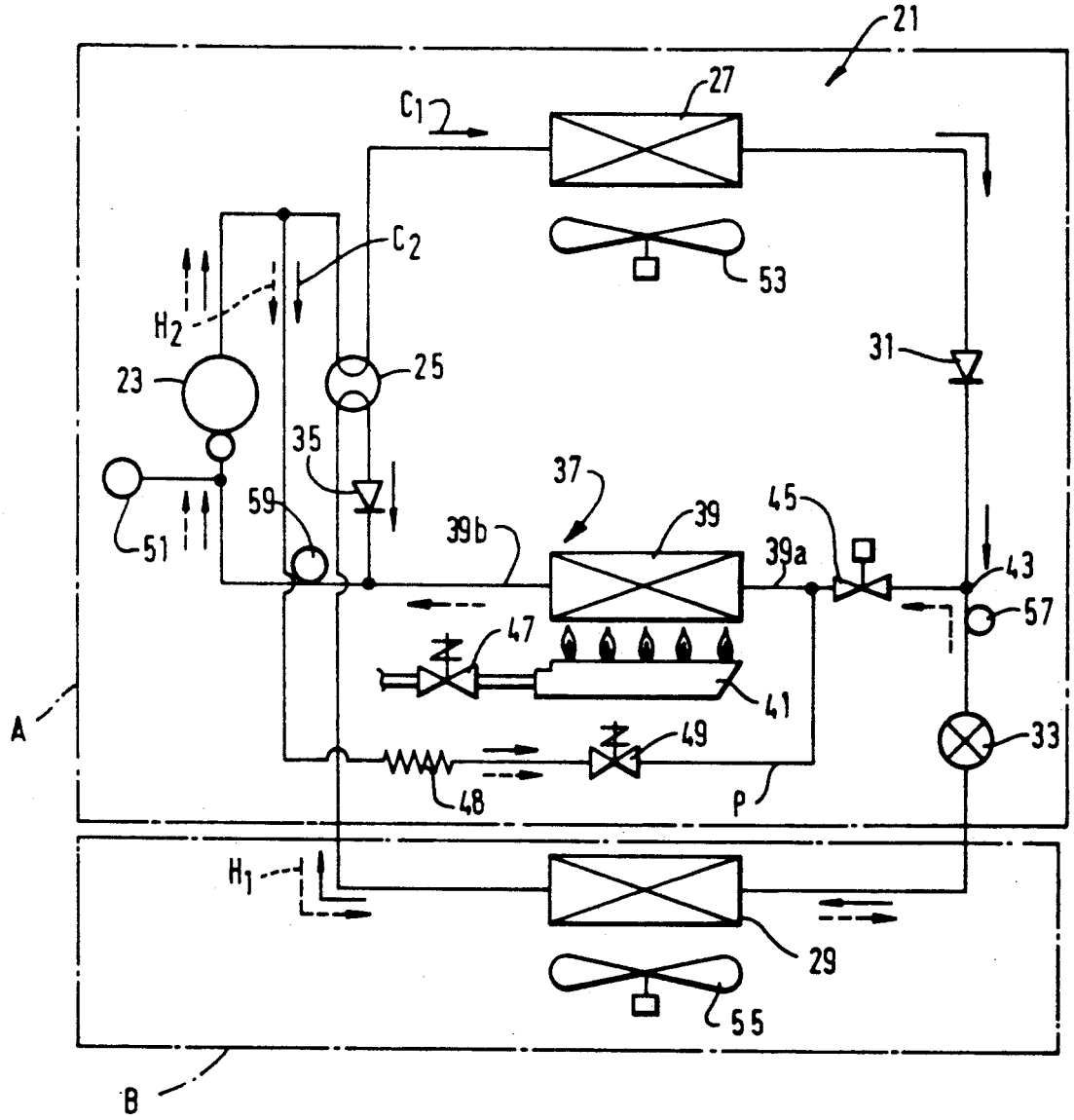
FIG. 1 is a diagram of a refrigerating circuit of one embodiment of the present invention.

FIG. 1 shows a heat pump type air conditioning apparatus including a refrigerant heating device. The heat pump type air conditioning apparatus carries out a heating operation by the combination of a heat pump action of the refrigerating circuit and a refrigerant heating action of the refrigerant heating device. A refrigerating circuit 21 of this embodiment includes a variable capacity compressor 23 to compress refrigerant at a prescribed level and the refrigerant flows through refrigerating circuit 21. The output port of compressor 23 is connected through a four-way valve 25 to an external heat-exchanger 27. External heat-exchanger 27 is connected to one end of an internal heat-exchanger 29 through a check valve 31 (in a forward direction) and a decompressing device, e.g., a pulse motor driven expansion valve 33. The other end of internal heat-exchanger 29 is connected to the input port of compressor 23 through four-way valve 25 and a check valve 35 (in a forward direction).

A refrigerant heating device 37 includes a heat-exchanger 39 and a gas burner 41, which heats heat-exchanger 39. An amount of gas fuel supplied to burner 41 is controlled by an electric gas flow rate control valve 47 (proportional control valve). Heat-exchanger 39 has an input side 39*a* connected to a connecting point 43 of check valve 31 and expansion valve 33 through a bidirectional valve 45 and an output side 39*b* connected to the input port of compressor 23.

A capillary tube 48 and a bidirectional valve 49 are provided between the output port of compressor 23 and the connecting point of bidirectional valve 45 and the input side 39*a* of heat-exchanger 39 with a bypass line P.

A low pressure switch 51 is located at the input port side of compressor 23. Low pressure detection switch 51 outputs an ON-signal when the input pressure Ps of compressor 23 decreases to a prescribed set pressure Po, e.g., 0.5 kg/cm$^2$.

External and internal fan devices 53 and 55 are respectively arranged close to the corresponding external and internal heat-exchangers 27 and 29.

A first refrigerant temperature sensor 57 is located between the connecting point 43 and expansion valve 33 and a second refrigerant temperature sensor 59 is located between input port of compressor 23 and the connecting point of the output side of heat-exchanger 39 and bidirectional valve 35 to detect a refrigerant super heating.

An external unit A, i.e., a refrigerant supply unit, includes compressor 23, four-way valve 25, external heat-exchanger 27, external fan device 53, expansion valve 33 and refrigerant heating device 37. An internal unit B, i.e., an air conditioning unit, includes internal heat-exchanger 29 and internal fan device 55.

A control circuit of the above-described air conditioning apparatus will now be described.

Figure 2:
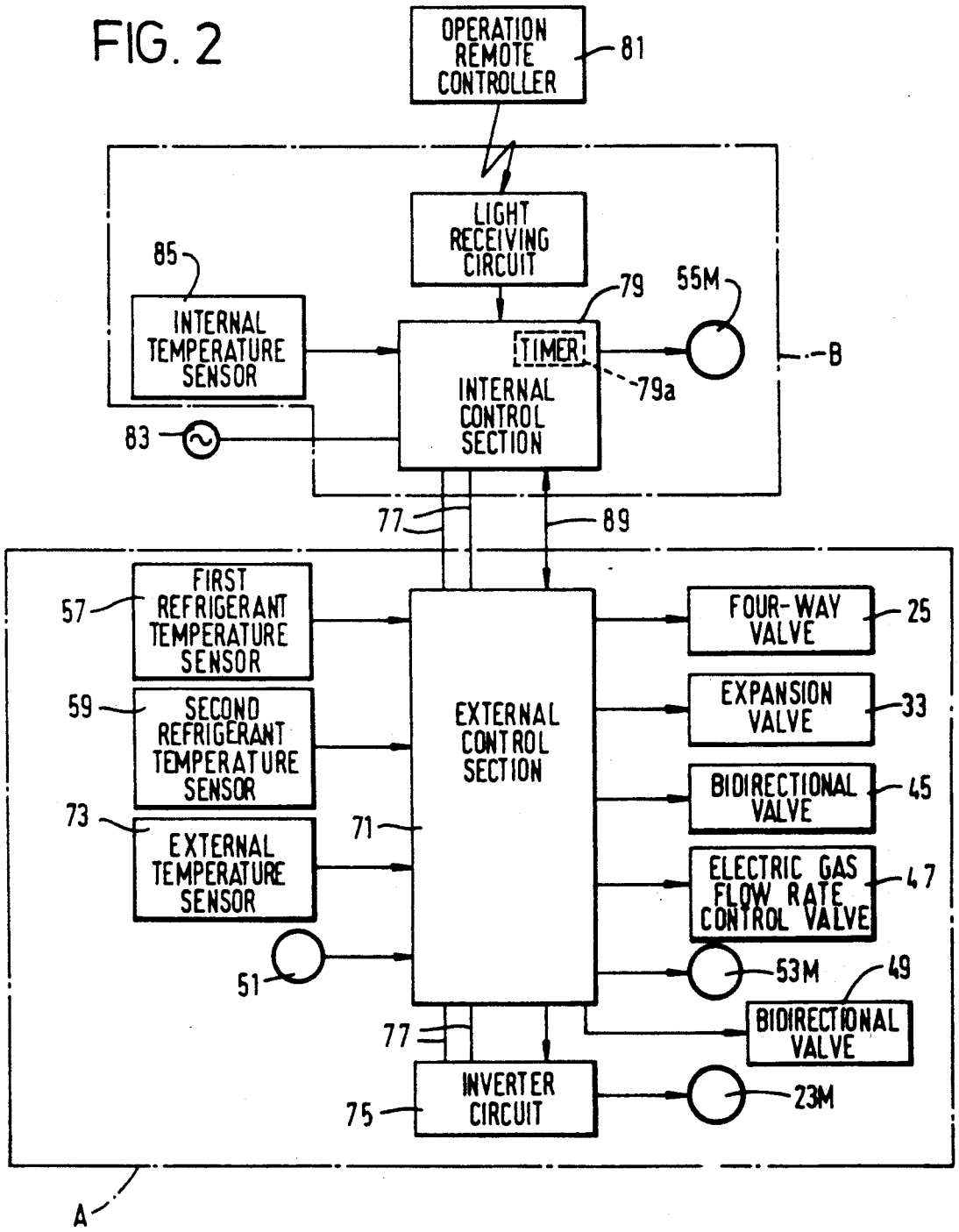
FIG. 2 is a block diagram of a control circuit of the one embodiment shown in FIG. 1.

As shown in FIG. 2, external unit A includes an external control section 71 composed of a microcomputer and its peripheral circuits to control overall operations of external unit A. First and second refrigerant temperature sensors 57 and 59, an external temperature sensor 73, and low pressure detection switch 51 are respectively connected to external control section 71. Four-way valve 25, expansion valve 33, bidirectional valves 45 and 49, electric gas flow rate control valve 47 and a fan motor 53M of external fan device 53 are also connected to external control section 71, respectively. An inverter circuit 75 is connected to external control section 71 to control the rotational speed of a compressor motor 23M. Inverter circuit 75 rectifies an AC voltage from a commercial power line 77 and outputs an AC voltage having a prescribed frequency and voltage level in response to a command from external control section 71.

An internal unit B includes an internal control section 79 to control overall operations of internal unit B. Internal control section 79 transmits operational commands inputted from an operation remote controller 81 to external control section 71. Internal control section 79 includes a microcomputer and its peripheral circuits.

An AC voltage is supplied to internal control section 79 from a commercial power supply 83 and is further supplied to external control section 71 through commercial power line 77. An internal temperature sensor 85 and a fan motor 55M of internal fan device 55 are connected to internal control section 79. Infrared rays, output from operational remote controller 81, which is modulated with a command signal is transmitted through a light receiving circuit 87 to internal control section 79. Internal control section 79 is connected to external control section 71 through a serial signal line 89 to transmit operational data to external control section 71.

Internal and external control sections 79 and 71 carries out following functions;

1. First function executing a cooling pre-starting operation wherein bidirectional valve 45 is closed and carrying out a cooling operation in which refrigerant fed from compressor 23 flows through four-way valve 25, external heat-exchanger 27, check valve 31, expansion valve 33, internal heat-exchanger 29, four-way valve 25 and check valve 35 along the direction indicated by a solid arrow C1;

2. Second function controlling the driving frequency of compressor 23 (output frequency of inverter circuit 75) on the basis of a difference, i.e., an air conditioning load, between an actual room temperature Ta detected by internal temperature sensor 85 and a set temperature (desired room temperature) Ts from operation remote controller 81 in the cooling operation;

3. Third function opening bidirectional valve 49 when a refrigerant temperature T1 detected by first refrigerant temperature sensor 57 is lower than a prescribed temperature T10, e.g., 30° C., and a refrigerant temperature T2 detected by second refrigerant temperature sensor 59 is lower than a predetermined temperature T20, e.g., 0° C., in the cooling operation to flow an amount of refrigerant through capillary tube 48, bidirectional valve 49 and refrigerant heating device 37 along the direction indicated by a solid arrow C2;

4. Fourth function closing bidirectional valve 49 when refrigerant temperature T1 is greater than the prescribed temperature T10 or refrigerant temperature T2 is greater than the predetermined temperature T20 in the cooling operation;

5. Fifth function executing a heating pre-starting operation wherein the activation of four-way valve 25, the opening of bidirectional valve 45 and the operation of refrigerant heating device 37 are carried out, and carrying out a heating operation in which refrigerant fed from compressor 23 flows through four-way valve 25, internal heat-exchanger 29, expansion valve 33, bidirectional valve 45, refrigerant heating device 37, four-way valve 25 and check valve 35 along the direction indicated by a dotted arrow H1;

6. Sixth function controlling the driving frequency of compressor 23 (the output frequency of inverter circuit 75) on the basis of a difference, i.e., a heating load, between set temperature Ts input from operational remote controller 81 and actual room temperature Ta detected by internal temperature sensor 85 in the heating operation;

7. Seventh function calculating a difference $\Delta T$ (T2−T1) between the detected temperature T2 of the second refrigerant temperature sensor 59 and the first refrigerant temperature sensor 57 in the heating operation;

8. Eighth function controlling a degree of opening of pulse motor driven expansion valve 33 so that the difference $\Delta T$, i.e., a refrigerant super heating, becomes a prescribed value $\Delta Tsa$, e.g., 5°~8° C., in the heating operation;

9. Ninth function which decreases a heating amount of refrigerant heating device 37 (the combustion amount of gas burner 41) by decreasing the degree of opening of electric gas flow rate control valve 47 when the detected temperature T2 of the second refrigerant temperature sensor 59 exceeds a predetermined value Teo, e.g., 70° C., (a refrigerant temperature upper limit valve) in the heating operation;

10. Tenth function maintaining the activation of four-way valve 25 even after the halt of the heating operation;

11. Eleventh function which drives compressor 23 and carries out a heating operation after executing the refrigerant collecting operation as refrigerant heating device 37 is pre-heated when an elapsed period of time Et greater than a set time Pt, e.g., two hours, from the halt of the heating operation to the re-start of the heating operation, actual room temperature Ta lower than a prescribed set temperature Ts1, e.g., 20° C., and an external temperature Tex lower than a predetermined temperature Ts2, e.g., 10° C., are satisfied;

12. Twelfth function carrying out a heating operation immediately when the elapsed period of time Et smaller than the set time Pt from the halt of the heating operation to the re-start of the heating operation, the actual room temperature Ta greater than the prescribed set temperature Ts1, or an external temperature Tex greater than the predetermined temperature Ts2 is satisfied;

13. Thirteenth function carrying out a refrigerant collecting operation collecting refrigerant stored in external heat-exchanger 27 through refrigerant heating device 37; and 14. Fourteenth function which halts the refrigerant collecting operation when the suction pressure Ps of the input port of compressor 23 reaching a set pressure Po is detected during the refrigerant collecting operation or the elapsed period of time Et is greater than the set time Pt.

Operations of the above-described air conditioning apparatus will now be described. A desired room temperature Ts is inputted from operation remote controller 81 to internal control section 79. When a heating operation is started, a comparison between the actual room temperature Ta detected by internal temperature sensor 85 and the desired room temperature Ts is executed. If the actual room temperature Ta is lower than the desired room temperature Ts, bidirectional valves 45 and 49 are opened and compressor 23 is driven. Simultaneously, four-way valve 25 is activated and a gas fuel is supplied to gas burner 41 to operate refrigerant heating device 37.

A part of refrigerant fed from compressor 23 flows through capillary tube 48, bidirectional valve 49 and heat-exchanger 39 of refrigerant heating device 37 in the direction indicated by a dotted arrow H2 in FIG. 1, if the heating/cooling load is small. Thus, bypass line P regulates the amount of refrigerant flowing through refrigerating circuit 21. Remaining refrigerant fed from compressor 23 also flows through four-way valve 25, internal heat-exchanger 29, expansion valve 33, bidirectional valve 45, and heat-exchanger 39 of refrigerant heating device 37 along the direction indicated by a dotted arrow H1 in FIG. 1. Thus, internal heat-exchanger 29 acts as a condenser and heat-exchanger 39 of refrigerant heating device 37 acts as an evaporator to blow a heated air into the room to be heated. During the heating operation, the driving frequency of compressor 23 is controlled by inverter circuit 75 in accordance with a heating load obtained by calculating a difference between the actual room temperature Ta detected by internal temperature sensor 85 and the desired room temperature Ts set by operation remote controller 81.

In addition, the temperature T1 detected by first refrigerant temperature sensor 57, i.e., a temperature of refrigerant flowing into heat-exchanger 39 of refrigerant heating device 37 through expansion valve 33, and the temperature T2 detected by second refrigerant temperature sensor 59, i.e., a temperature of refrigerant flowing from heat-exchanger 39 are respectively inputted into external control section 71. Then, a temperature difference $\Delta T$ between temperatures T2 and T1 is calculated. The temperature difference $\Delta T$ corresponds to a refrigerant super heating at refrigerant heating device 37. A degree of opening of expansion valve 33 is regulated so that the temperature difference $\Delta T$ becomes a prescribed value $\Delta Tsa$.

According to this regulation of opening degree of expansion valve 33, the operation of refrigerating circuit 21 shown in FIG. 1 is stabilized.

Figure 3:
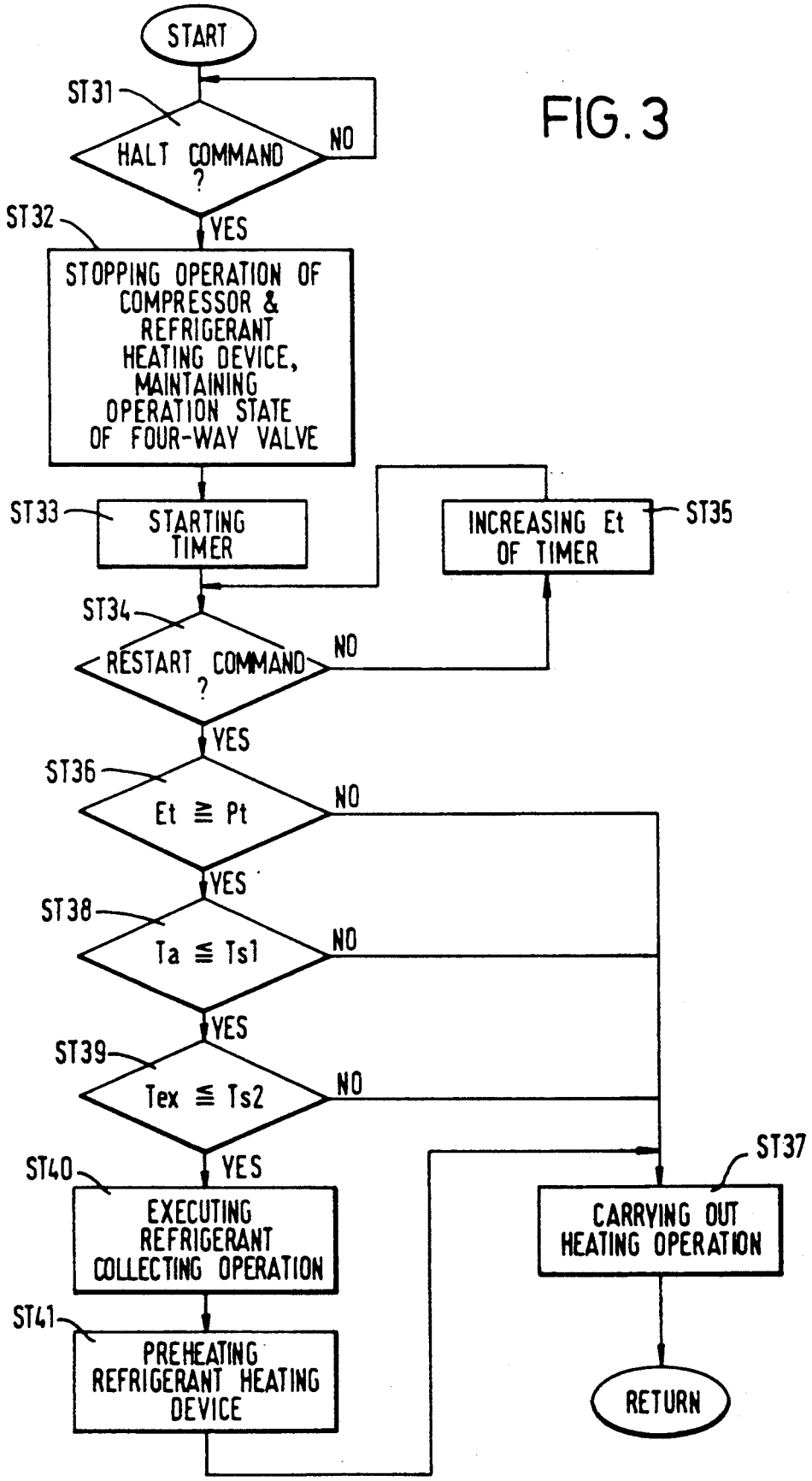
FIG. 3 is a flow chart of an operation of the one embodiment.

An operation shown in FIG. 3 is carried out immediately after the halt of the heating operation is commanded.

In step ST31, the YES-path is taken when the halt command is issued. Otherwise, the NO-path is taken. In step ST32, the operation of compressor 23 and refrigerant heating device 37 are stopped and the operation state of four-way valve 25 is maintained. The operation of a timer **79*a* provided in internal control section 79 begins in step ST33. Timer 79*a*** measures an elapsed period of time from a halt of the heating operation to a restart of the heating operation. In step ST34, when a restart command of the heating operation is issued, the YES-path is taken. Otherwise, the NO-path is taken and the count value Et of timer 79*a* is increased in step ST35. Then, step ST34 is re-executed.

When the YES-path is taken in step ST34, the count value Et (the elapsed period of time) of timer 79*a* is compared with the predetermined period of time Pt in step ST36. If the count value Et of timer 79*a* is greater than the predetermined period of time Pt, the YES-path is taken. Otherwise, the NO-path is taken and the heating operation is started in step ST37. Compressor 23 and refrigerant heating device 37 are operated. Thus, the starting of the heating operation is accelerated.

When the YES-path is taken in step ST36, the actual room temperature Ta detected by internal temperature sensor 85 is compared with the prescribed temperature value Ts1, e.g., 20° C., in step ST38. If the actual room temperature Ta is below the prescribed temperature value Ts1, the YES-path is taken. Otherwise, the NO-path is taken and the step ST37 is executed.

When the YES-path is taken in step ST38, the external temperature Tex detected by external temperature sensor 73 is compared with the predetermined temperature value Ts2, e.g., 10° C. in step ST39. If the external temperature Tex is below the predetermined temperature valve Ts2, the YES-path is taken. Otherwise, the NO-path is taken and the step ST37 is executed.

When the YES-path is taken in step ST39, the refrigerant collecting operation is executed for a given operation period of time Tg in step ST40. During the execution of the refrigerant collecting operation, bidirectional valve 49 is closed and heat-exchanger 39 of refrigerant heating device 37 is pre-heated by a minimum combustion amount of gas burner 41 in step ST41. Refrigerant including lubricating oil of compressor 23, which is stored in external heat-exchanger 27 is collected to compressor 23 by a suction pressure of compressor 23. After the given operation period of time Tg is elapsed, the heating amount of refrigerant heating device 37 is controlled in response to the heating load, and thus a normal heating operation is started in step ST37.

Figure 4:
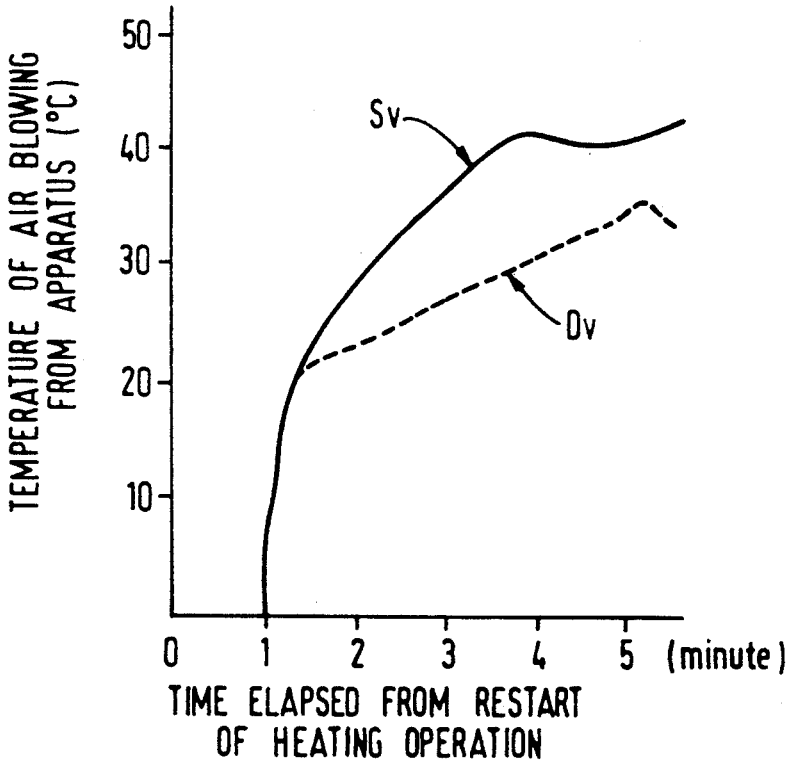
FIG. 4 is a graph showing changes in the temperature of heated air of an air conditioning apparatus of one embodiment and of a conventional air conditioning apparatus in terms of the elapsed time from the start of the heating operation.

As described above, when the elapsed period of time Et greater than the prescribed period of time Pt from the halt of the heating operation to the restart of the heating operation, the actual room temperature Ta lower than the predetermined temperature Ts1, and the external temperature Tex lower than the predetermined temperature Ts2 are satisfied, the heating operation is restarted after the refrigerant collecting operation is carried out as the refrigerant heating device 37 is preheated. Thus, a sufficient amount of refrigerant used in the heating circuit is ensured and the heating capacity is enhanced. In addition, the starting of the heating circuit at the restart of the heating operation is accelerated. FIG. 4 shows the restarting characteristic of the apparatus indicated by the development of air blowing from the apparatus in the heating operation when the heating operation is restarted at 0° C. of internal and external temperatures after ten hours has been elapsed from the halt of the heating operation. The restarting characteristic of the apparatus of the one embodiment is indicated by a solid curve Sv and the restarting characteristic of the conventional apparatus is indicated by a dotted curve Dv. As can be seen in FIG. 4, the restarting of the apparatus of the one embodiment is greatly improved, as compared with that of the conventional apparatus.

Figure 5:
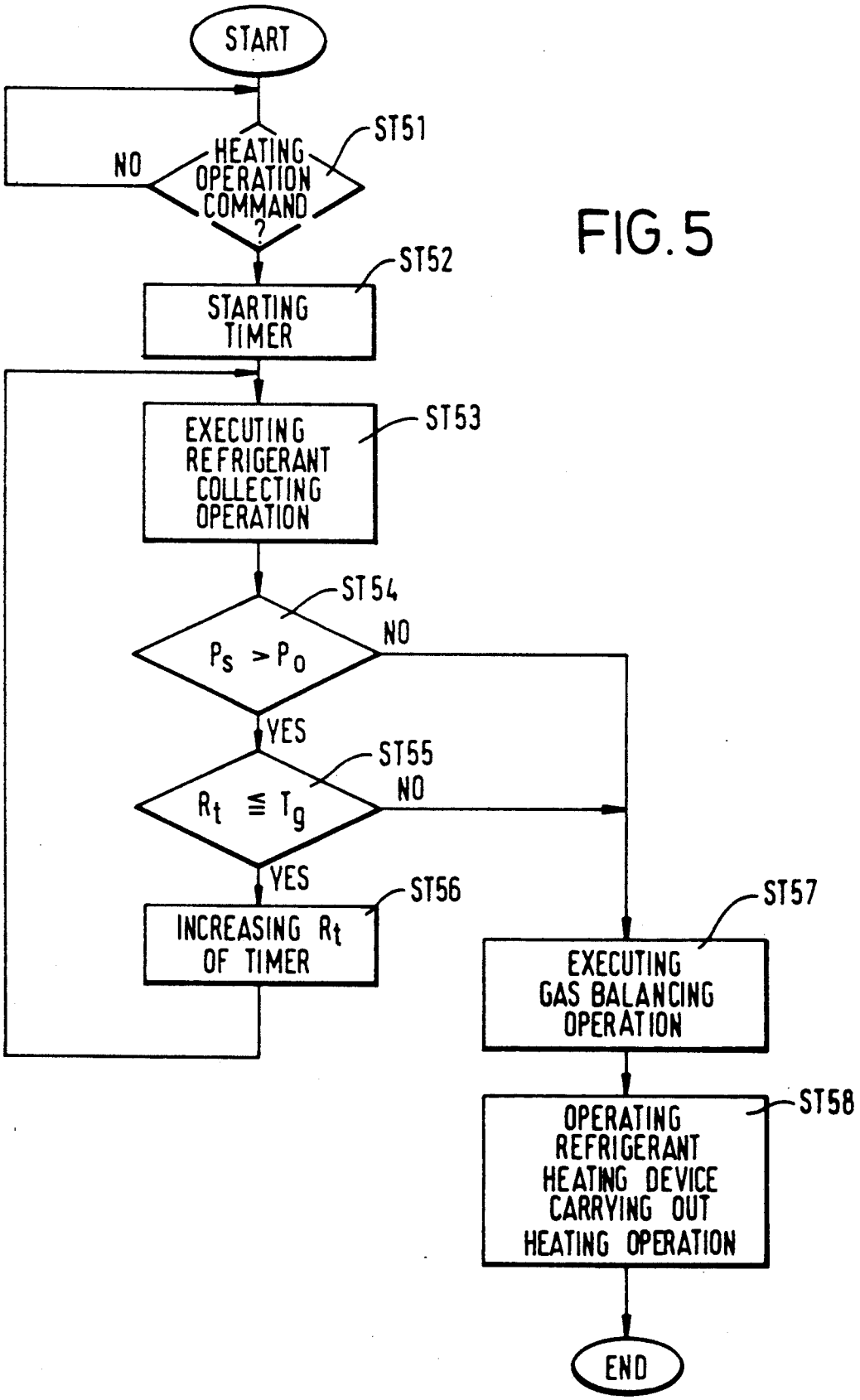
FIG. 5 is a flow chart of an operation of a second embodiment of the present invention.

A second embodiment of the present invention will now be described with reference to FIG. 5. In the above-described first embodiment, the refrigerant collecting operation is carried out for the given operation period of time Tg. However, in the second embodiment, the refrigerant collecting operation is forcibly terminated before the given operation period of time Tg is elapsed when a prescribed condition occurs.

When a heating operation command is issued from operation remote controller 81, the YES-path is taken in step ST51. Otherwise, the NO-path is taken. In step ST52, timer 79*a* is started to measure a period of time for which the refrigerant collecting operation is carried out. The refrigerant collecting operation is carried out in step ST53. Compressor 23 is operated immediately after bidirectional valves 45 and 49 are closed. At this time, the operation state of four-way valve 25 has been maintained from the halt of the last heating operation. Thus, refrigerant stayed in external heat-exchanger 27 flows through four-way valve 25 and check valve 35, and then the refrigerant is collected to internal heat-exchanger 29 side through compressor 23.

In step ST54, the suction pressure Ps of compressor 23 detected by low pressure detection switch 51 is compared with the prescribed value Po. If suction pressure Ps is greater than the prescribed value Po, the YES-path is taken. Otherwise, the NO-path is taken. When the YES-path is taken in step ST54, the count value Rt of timer 79*a* is compared with the given operation period of time Tg in step ST55. If the count value Rt is smaller than the given operation period of time Tg, the YES-path is taken. The count value Rt of timer 79*a* is increased in step ST56 and the above-described refrigerant collecting operation is maintained in step ST53.

When the NO-path is taken in step ST54, a conventional gas balancing operation (a gas pressure balancing operation) is executed in step ST57. In this operation, a pressure difference between input and output ports of compressor 23 is regulated. If the pressure difference is large, a considerable amount of starting current flows through compressor motor 23M. During the gas balancing operation, the operation state of four-way valve 25 is maintained and bidirectional valve 49 is opened. After the gas balancing operation is completed, refrigerant heating device 37 is operated and the heating operation is started in step ST58.

When the NO-path is taken in step ST55, the above-described steps ST57 and ST58 are executed successively.

In the above-described second embodiment, the refrigerant collecting operation is finished when not only timer 79*a* achieves the given operation period of time Tg but also suction pressure Ps is equal to or smaller than the prescribed value Po. The operation of compressor 23 in a vacuum state in which the suction pressure Ps of compressor 23 has been a negative pressure is avoided. Thus, the overheating of the compressing section of compressor 23 is prevented and the damages to the compressing section of compressor 23 are also avoided.

Figure 6:
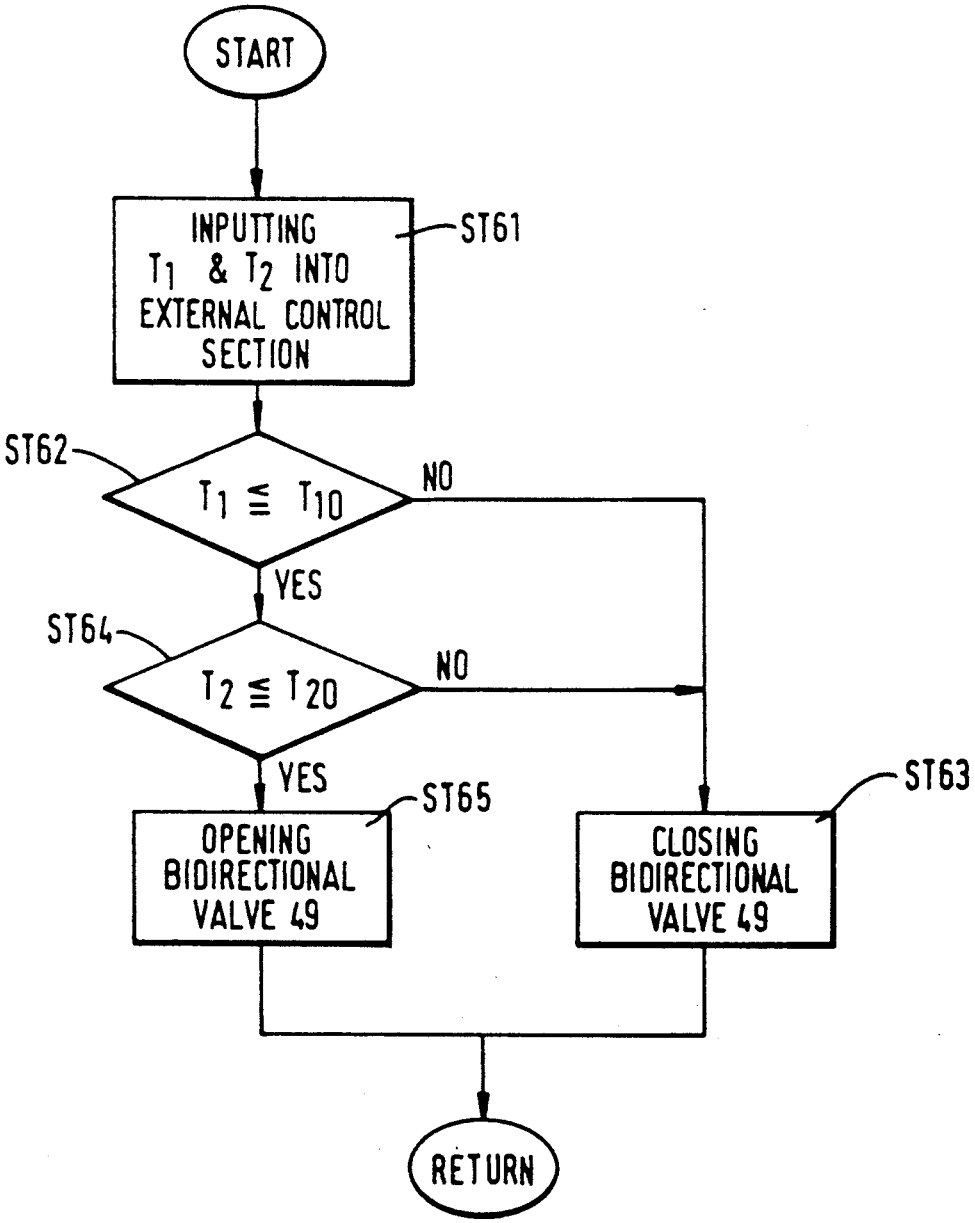
FIG. 6 is a flow chart of an operation of a third embodiment of the present invention.

A third embodiment of the present invention will be described with reference to FIG. 6.

In a cooling operation, bidirectional valve 45 is closed and then compressor 23 is operated. Refrigerant fed from compressor 23 flows through four-way valve 25, external heat-exchanger 27, check valve 31, expansion valve 33 and internal heat-exchanger 29 along the direction indicated by solid arrow C1 in FIG. 1. A part of refrigerant from compressor 23 bypasses four-way valve 25 and flows through capillary tube 48, bidirectional valve 49 and heat-exchanger 39 of refrigerant heating device 37 in the direction indicated by a solid arrow C2. Thus, internal heat-exchanger 29 acts as an evaporator and external heat-exchanger 27 acts as a condenser. However, bidirectional valve 49 is opened only when the cooling load is small. The bypass line P including capillary tube 48 and bidirectional valve 49 regulates an amount of refrigerant which flows through the refrigerating circuit 21.

The operation of bidirectional valve 49 will be described in more detail with reference to FIG. 6. During the cooling operation, a temperature T1 detected by first refrigerant temperature sensor 57 is sent to external control section 71 and a temperature T2 detected by second refrigerant temperature sensor 59 is also input to external control section 71 in step ST61. In step ST62, temperature T1 is compared with a prescribed temperature T10. If temperature T1 is smaller than the prescribed temperature T10, the YES-path is taken. Otherwise, the NO-path is taken and bidirectional valve 49 is closed in step ST63. When the YES-path is taken in step 62, temperature T2 is compared to a predetermined temperature T20 in step ST64. If temperature T2 is smaller than the predetermined temperature T20, the YES-path is taken. Otherwise, the NO-path is taken and the step ST63 is executed. Bidirectional valve 49 is closed. When the YES-path is taken in step ST64, bidirectional valve 49 is opened in step ST65.

As described above, bidirectional valve 49 is opened when compressor 23 is operated under a small cooling load wherein temperature T1 detected by first refrigerant temperature sensor 57 is smaller than the prescribed temperature T10 and temperature T2 detected by second refrigerant temperature sensor 59 is also smaller than the predetermined temperature T20. A part of refrigerant fed from compressor 23 returns to compressor 23 through bypass line P and heat-exchanger 39 of refrigerant heating device 37 without flowing through external heat-exchanger 27. A liquid refrigerant returning to the suction side of compressor 23 is significantly decreased and a decrease in the operational capacity of compressor 23 is avoided.

The present invention has been described with respect to specific embodiments. However, other embodiments based on the principles of the present invention should be obvious to those of ordinary skill in the art. Such embodiments are intended to be covered by the claims.

What is claimed is:

1. An air conditioning apparatus for heating or cooling air in a defined space comprising:

a compressor for circulating refrigerant;

a four-way valve connected to the high pressure side of said compressor;

a first heat exchanger positioned on an outlet side of said four-way valve;

a refrigerant heating device, the inlet side of said refrigerant heating device being connected to the outlet side of said first heat exchanger and the outlet side of said refrigerant heating device being connected to the inlet side of said compressor;

a second heat exchanger connected to said first heat exchanger to receive refrigerant fed from said first heat exchanger during a cooling operation and to send refrigerant fed from said compressor to said refrigerant heating device during a heating operation;

a decompressing device positioned between said first heat exchanger and said second heat exchanger for controlling the flow of said refrigerant;

timer means for measuring a standby period Et from the halt of a refrigerant heating operation to the restart of said heating operation;

means for detecting a temperature Ta in said defined space;

means for detecting a temperature Tex external to said defined space;

control means for selectively operating said refrigerant heating device in accordance with Et, Ta and Tex to carry out a refrigerant collecting operation from said second heat exchanger to said compressor when the restart of said heating operation is commanded.

2. An apparatus according to claim 1, wherein the control means includes means for maintaining the operation state of the four-way valve during the standby period Et in the heating operation.

3. An apparatus according to claim 2, wherein the control means includes means for carrying out the heating operation without executing the refrigerant collecting operation if the standby period Et is smaller than a prescribed period Pt when the restart of the heating operation is commanded.

4. An apparatus according to claim 2, wherein the control means includes means for carrying out the heating operation without executing the refrigerant collecting operation if the temperature Ta is greater than a predetermined temperature value Ts1 when the restart of the heating operation is commanded.

5. An apparatus according to claim 2, wherein the control means includes means for carrying out the heating operation without executing the refrigerant collecting operation if the external temperature Tex is greater than a given temperature value Ts2 when the restart of the heating operation is commanded.

6. An apparatus according to claim 2, wherein the control means includes means for carrying out the refrigerant collecting operation for a given operation period Tg before the heating operation is begun if the standby period Et greater than the prescribed period Pt, the temperature Ta lower than the predetermined temperature value Ts1, and the external temperature Tex lower than the given temperature value Ts2 are satisfied when the restart of the heating operation is commanded.

7. An apparatus according to claim 6, wherein said refrigerant heating device includes a third heat-exchanger and the control means includes means for executing a preheating of the refrigerant heating device wherein the third heat-exchanger of the refrigerant heating device is preheated by a heating unit during the execution of the refrigerant collecting operation.

8. An apparatus according to claim 6, wherein the compressor is a variable capacity compressor which has an input port at which a suction pressure Ps is changed during the execution of the refrigerant collecting operation, and the apparatus further includes pressure detecting means for detecting the suction pressure Ps of the input port of the compressor.

9. An apparatus according to claim 8, wherein the control means includes means for terminating the refrigerant collecting operation when the detected suction pressure Ps of the input port of the compressor is not greater than a predetermined pressure Po even if the given operation period Tg has not been elapsed.

10. An apparatus according to claim 8, wherein the variable capacity compressor has an output port side, and a third heat-exchanger of the refrigerant heating device has an input side, the apparatus further including.

means for carrying out a cooling operation wherein refrigerant fed from the variable capacity compressor flows through the four-way valve, the second heat-exchanger, the decompressing device and the first heat-exchanger, a bypass line, having a capillary tube and a bidirectional valve for opening/closing the bypass line, connected between the output port side of the variable capacity compressor and the input side of the third heat-exchanger, first temperature detecting means for detecting a temperature T1 of refrigerant flowing to the decompressing device, and second temperature detecting means for detecting a temperature T2 of refrigerant flowing from the second heat-exchanger.

11. An apparatus according to claim 10, wherein the control means includes means for opening the bidirectional valve of the bypass line in response to the temperature T1 not higher than a prescribed temperature value T10 and the temperature T2 not higher than a predetermined temperature value T20 smaller than the prescribed temperature value T10 to flow a part of refrigerant output from the compressor to the third heat-exchanger through the bypass line in the cooling operation.

* * * * *